US006464295B1

(12) United States Patent
Bergeron et al.

(10) Patent No.: US 6,464,295 B1
(45) Date of Patent: Oct. 15, 2002

(54) SAFE LOCKING ASSEMBLY FOR A GLIDER ROCKER

(75) Inventors: Sylvain Bergeron, Rock-Forest (CA); Steve Hoffman, High Point; Marcus Lindsey Murphy, Lexington, both of NC (US)

(73) Assignee: Shermag Inc., Sherbrooke (CA)

( * ) Notice: Subject to any disclaimer, the term of this patent is extended or adjusted under 35 U.S.C. 154(b) by 57 days.

(21) Appl. No.: 09/713,622

(22) Filed: Nov. 15, 2000

(51) Int. Cl.[7] ..... A47C 3/02

(52) U.S. Cl. ..... 297/270.4; 297/270.2; 297/270.3; 297/281

(58) Field of Search ..... 297/270.2, 270.3, 297/270.4, 270.1, 273, 281, 282

(56) References Cited

U.S. PATENT DOCUMENTS

| | | | | |
|---|---|---|---|---|
| 702,331 A | * | 6/1902 | Roberts | 297/270.2 |
| 3,815,954 A | | 6/1974 | Rogers, Jr. et al. | 297/271 |
| 3,826,532 A | | 7/1974 | Caldemeyer | 297/270 |
| 4,212,494 A | | 7/1980 | Dabney | 297/69 |
| 4,601,513 A | | 7/1986 | Pine | 297/270 |
| 4,707,026 A | * | 11/1987 | Johansson | 297/270.1 |
| 4,893,871 A | | 1/1990 | Kowalski | 297/270 |
| 5,121,967 A | | 6/1992 | Rogers | 297/270 |
| 5,248,120 A | | 9/1993 | Brien | 248/370 |
| 5,344,214 A | | 9/1994 | Trent | 297/270 |
| 5,704,686 A | | 1/1998 | May | 297/281 |
| 5,749,625 A | | 5/1998 | Robinson | 297/367 |
| 5,765,913 A | | 6/1998 | LaPointe et al. | 297/281 |
| 5,795,021 A | | 8/1998 | Rogers | 297/281 |
| 6,033,020 A | | 3/2000 | Ito | 297/302.4 |
| 6,120,094 A | * | 9/2000 | Parent | 297/270.3 |
| 6,213,551 B1 | * | 4/2001 | Desnoyers et al. | 297/270.2 |

FOREIGN PATENT DOCUMENTS

| | | |
|---|---|---|
| CA | 2234181 | 4/1998 |

* cited by examiner

*Primary Examiner*—Peter R. Brown
(74) *Attorney, Agent, or Firm*—Collard & Roe, P.C.

(57) ABSTRACT

A locking assembly for a glider rocker having a gliding chair seat mounted on a stationary base. A latch bar is adapted to extend horizontally and transversely with respect to a gliding direction of the chair seat. A mounting assembly is provided for attaching the latch bar to the chair seat, the mounting assembly being operable for selectively lifting and lowering the latch bar with respect to the chair seat. A bracket affixable to the base, has an upper end provided with a downwardly extending catch slot into which the latch bar slideably fits when the latch bar is aligned therewith and lowered by operation of the mounting assembly.

17 Claims, 5 Drawing Sheets

FIG. 4
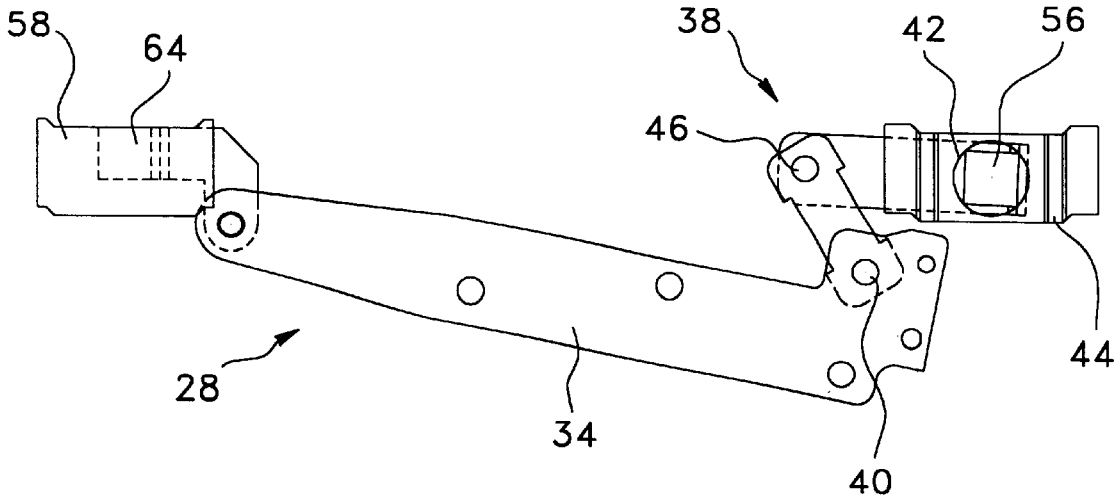
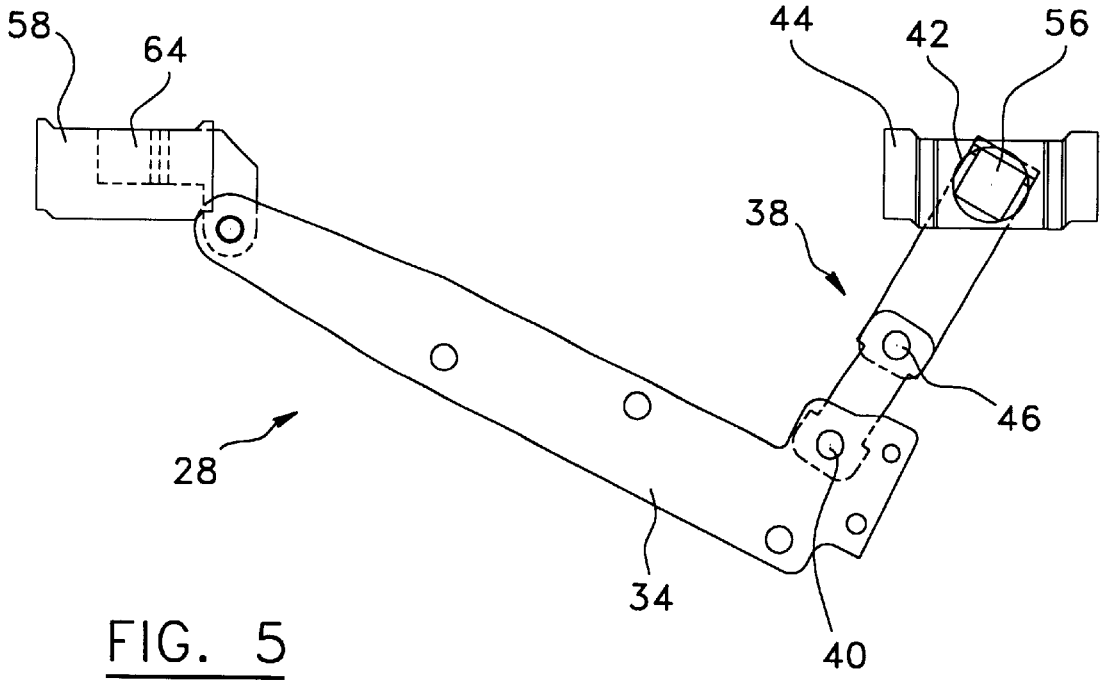
FIG. 5

SAFE LOCKING ASSEMBLY FOR A GLIDER ROCKER

FIELD OF THE INVENTION

The present invention relates to a locking assembly for a glider rocker, designed in particular for safe operation.

BACKGROUND

Many configurations of locking assemblies and locking devices have been developed so far in relation with rocking, reclining or gliding chairs. Examples of such configurations, illustrating the state of the art, can be found in U.S. Pat. No. 3,815,954 (Rogers, Jr. et al.); U.S. Pat. No. 3,826,532 (Caldemeyer); U.S. Pat. No. 4,212,494 (Dabney); U.S. Pat. No. 4,601,513 (Pine); U.S. Pat. No. 4,893,871 (Kowalski); U.S. Pat. No. 5,121,967 (Rogers); U.S. Pat. No. 5,248,120 (Brien); U.S. Pat. No. 5,344,214 (Trent); U.S. Pat. No. 5,704,686 (May); U.S. Pat. No. 5,749,625 (Robinson); U.S. Pat. No. 5,765,913 (LaPointe et al.); U.S. Pat. No. 5,795,021 (Rogers); and U.S. Pat. No. 6,033,020 (Ito).

Also known in the art is laid-open Canadian patent application No. 2,234,181 (Desnoyers et al.), which shows a locking mechanism for a glider rocker. The mechanism has toothed rails and locking pins respectively mounted on the rocker's base and gliding seat, and arranged so that a lifting or lowering of the rails according to the selected configuration will result in a locking engagement of the pins between teeth of the rails, thereby stopping movement of the gliding seat with respect to the base. The design of the mechanism is however prone to disengagement of the rails from the pins, which may happen at undesired times and may be unsafe.

SUMMARY

An object of the invention is to provide a safer locking assembly for a glider rocker, which may be either added on existing glider rockers or provided during the manufacturing process of new glider rockers.

Another object of the invention is to provide such a locking assembly for a glider rocker, which is simple in construction, thus highly cost-competitive, yet is highly reliable and efficient.

According to the present invention, there is provided a locking assembly for a glider rocker having a gliding chair seat mounted on a stationary base. A latch bar is adapted to extend horizontally and transversely with respect to a gliding direction of the chair seat. Mounting means are provided for attaching the latch bar to the chair seat, the mounting means being operable for selectively lifting and lowering the latch bar with respect to the chair seat. A bracket affixable to the base, has an upper end provided with a downwardly extending catch slot into which the latch bar slideably fits when the latch bar is aligned therewith and lowered by operation of the mounting means.

According to the invention, there is also provided a glider rocker equipped with the above locking assembly.

BRIEF DESCRIPTION OF THE DRAWINGS

A detailed description of preferred embodiments will be given herein below with reference to the following drawings, in which like numbers refer to like elements:

FIGS. 4 and 5 are side views of a locking assembly according to the invention, without the locking brackets, in retracted (unlocked) and deployed (locked) positions respectively.

DETAILED DESCRIPTION OF THE PREFERRED EMBODIMENTS

Figure 1:
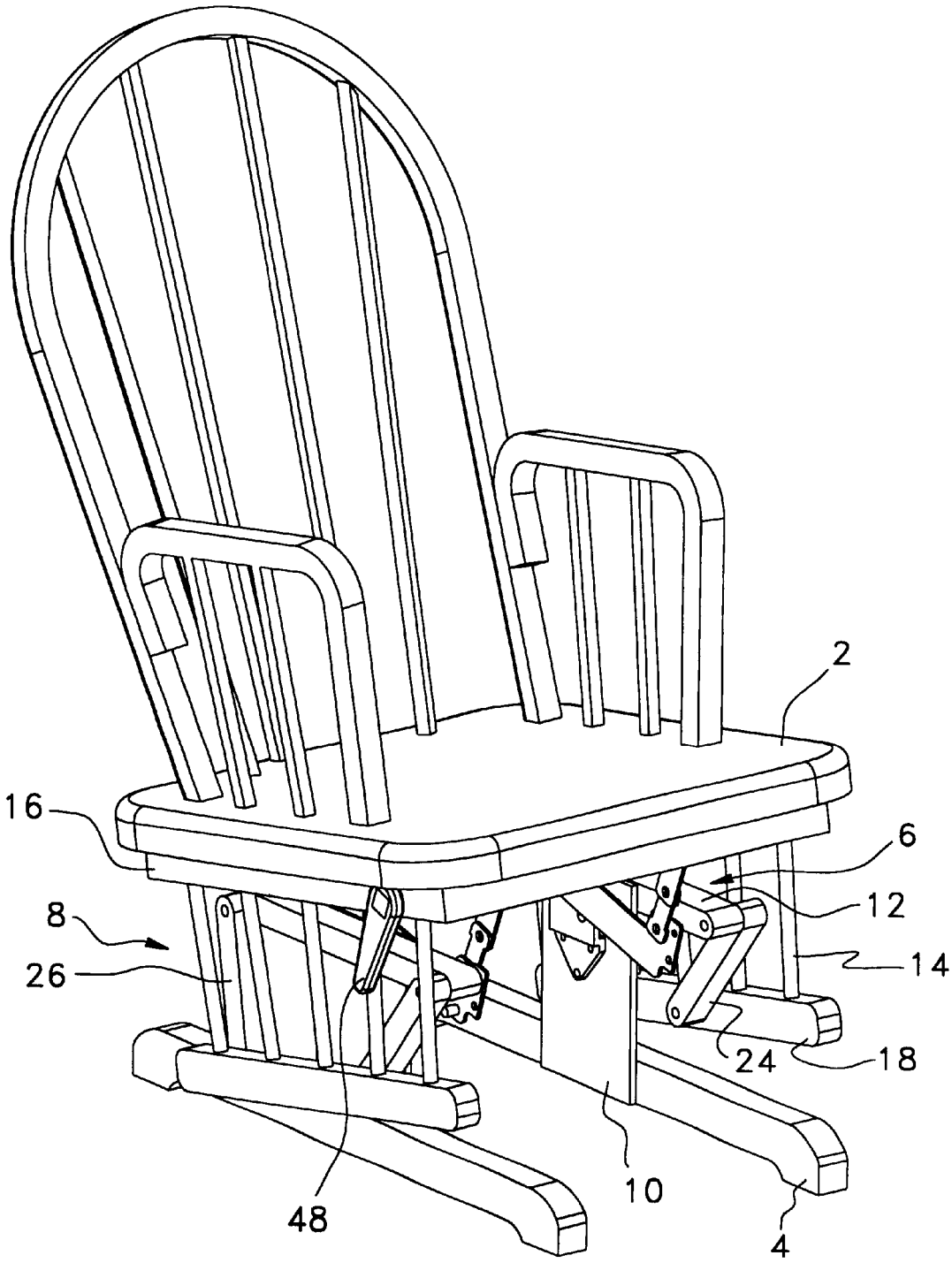
FIG. 1 is a perspective view of a glider rocker equipped with a locking assembly according to the invention.

Referring to FIG. 1, there is shown a glider rocker equipped with a locking assembly according to the invention. The glider rocker has a gliding chair seat 2 mounted on a stationary base 4.

Figure 2:
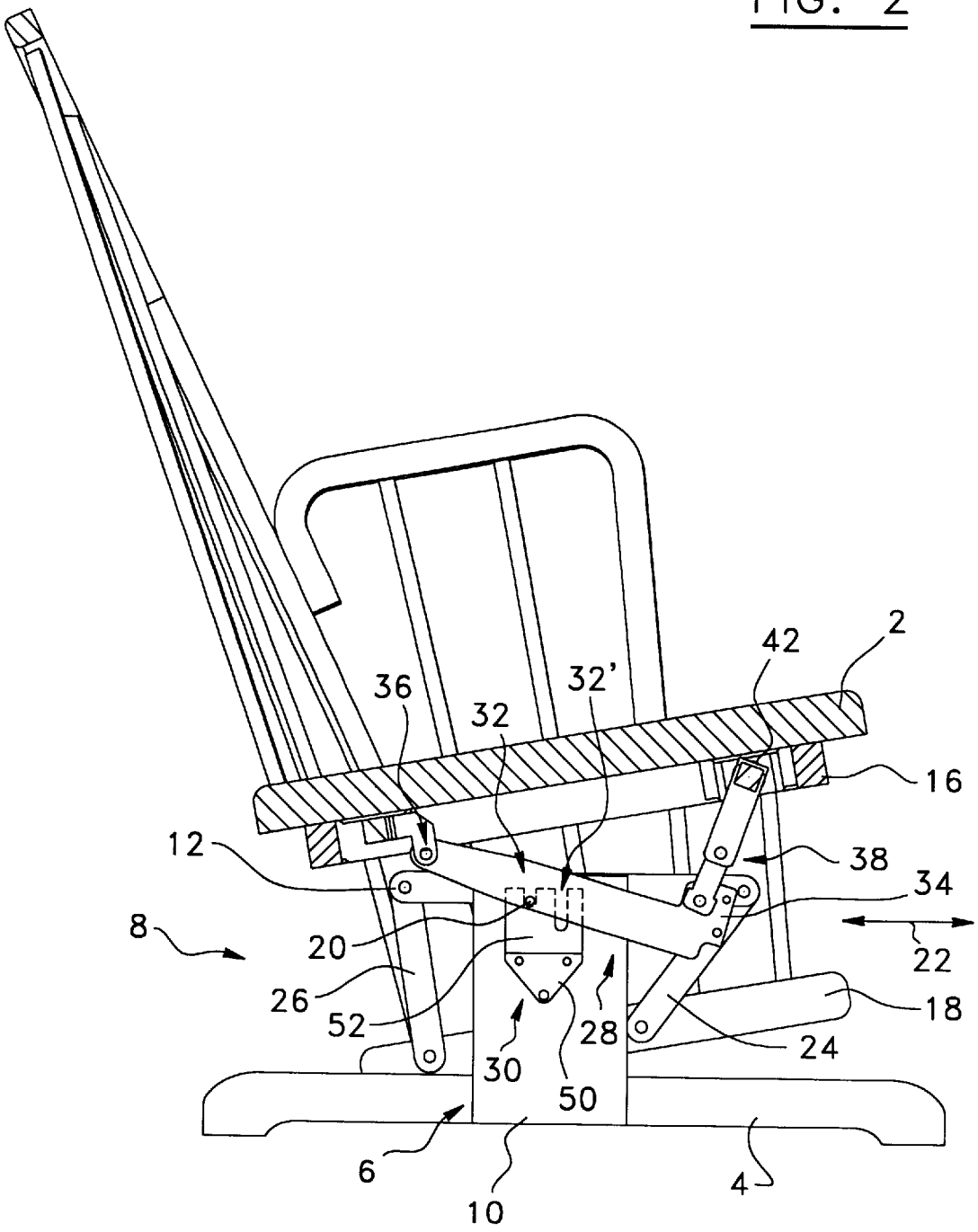
FIG. 2 is a cross-section side elevation view of a glider rocker equipped with a locking assembly according to the invention.

Referring to FIGS. 1 and 2, the stationary base 4 has a pair of parallel upright support members 6 (one of which is best shown in FIG. 2) extending on opposite sides of the base 4. The upright support members 6 may include upright posts 10 supporting upper beams 12, forming T-shaped figures on each side of the rocker, as illustrated. The chair seat 2 has a pair of parallel downwardly projecting side support members 8 extending on the opposite sides of the chair seat 2 and on outer sides of the support members 6 of the base 4. The side support members 8 may include a series of bars 14 extending between upper and lower beams 16, 18 as illustrated in FIG. 1. The chair seat 2 is glidingly mounted on the base 4 by means of front and rear pairs of parallel linkage bars 24, 26 having ends pivotally connected to the support members 8, 6 of the chair seat 2 and the base 4 respectively, at front and rear ends thereof.

Figure 3:
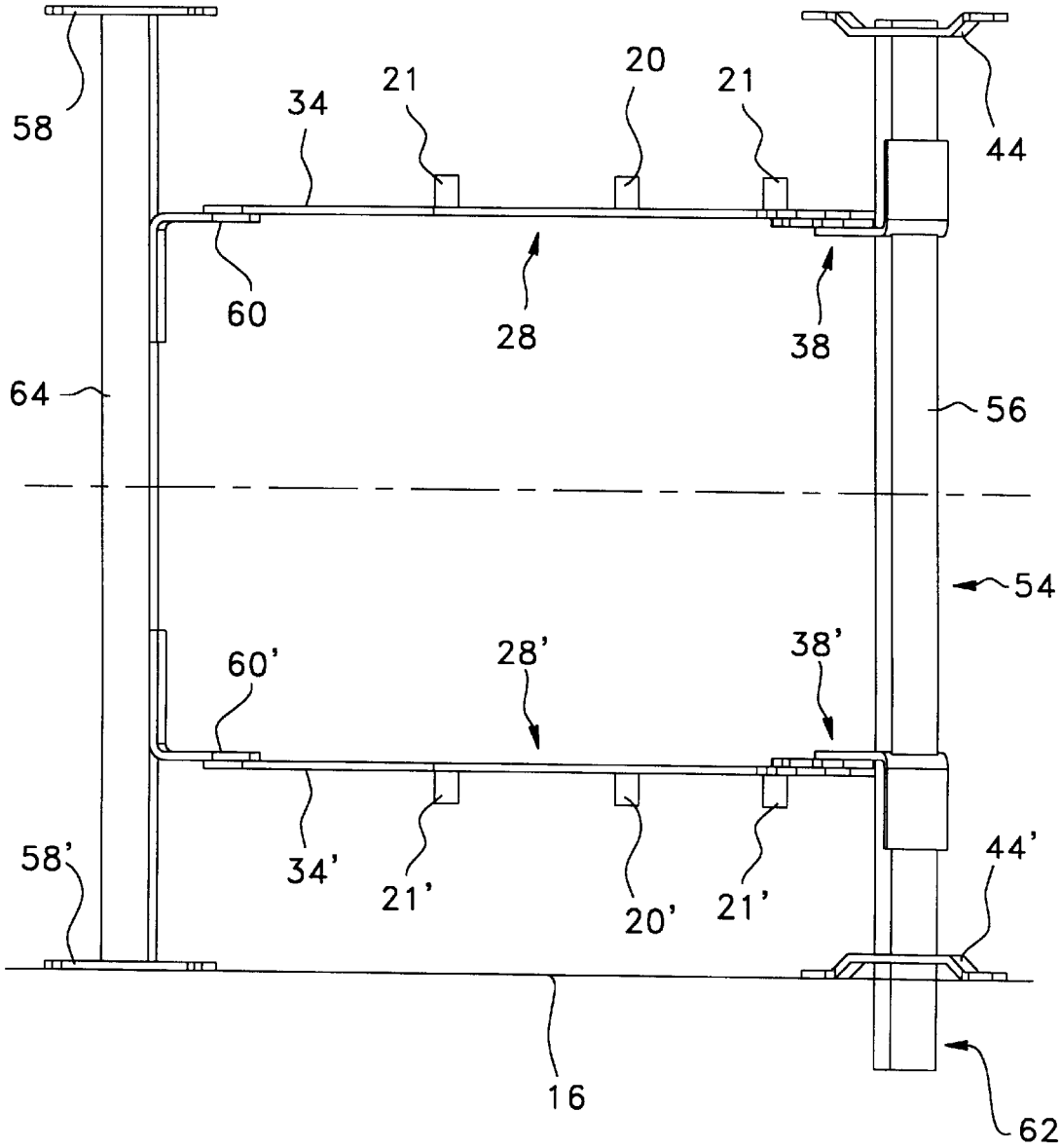
FIG. 3 is a top view of a locking assembly according to the invention, without the locking brackets.

Referring to FIG. 2, the locking assembly has a latch bar 20 adapted to extend horizontally and transversely with respect to a gliding direction of the chair seat 2, as depicted by arrow 22 (see FIG. 3 for a clearer view of the position of the latch bar 20). The latch bar 20 is attached to the chair seat 2 through a mounting assembly 28 operable for selectively lifting and lowering the latch bar 20 with respect to the chair seat 2, for example as illustrated in FIGS. 4 and 5, where the mounting assembly 28 is respectively shown in retracted (lifted) and deployed (lowered) positions. Thus, in use, the latch bar 20 actually moves with the chair seat 2 as it glides back and forth over the base 4.

The locking assembly also has a bracket 30 affixable to the base 4 and having an upper end provided with a downwardly extending catch slot 32 into which the latch bar 20 slideably fits when the latch bar 20 is aligned therewith and lowered by operation of the mounting assembly 28.

The mounting assembly 28 may be formed in many ways, for example using an elongated member 34 adapted to extend in the gliding direction 22. The elongated member 34 has a longitudinal face 36 from which the latch bar 20 transversely projects, as best shown in FIG. 3. The elongated member 34 has an end 36 that pivotally attaches to the chair seat 2, and an opposite end provided with a swinging linkage 38 that attaches to the chair seat 2 and is operable to lift and lower the opposite end of the elongated member 34.

Referring to FIGS. 4 and 5, the swinging linkage 38 may be formed of a twofold arm arrangement having an end 40 pivotally connected to the front end of the elongated member 34, an opposite end 42 that attaches to the chair seat 2 through a mounting bracket 44, and an intermediate pivot point 46.

As an example of another way of forming the mounting assembly 28, it could simply be made of a vertical slide (not shown in the Figures) downwardly projecting from the chair seat 2 and provided with a sliding bar for raising and lowering the latch bar 20.

Referring to FIG. 2, an actuating handle 48 is preferably operatively coupled to the end 42 of the twofold arm arrangement 38 to rotate it and swing the swinging linkage 38 either up or down, to retract or deploy the elongated member 34 to pull the latch bar 20 out of the catch slot 32 and unlock the rocker or, conversely, to insert the latch bar 20 in the catch slot 32 and lock the rocker.

Referring to FIGS. 2 and 3, the elongated member 34 is preferably provided with additional latch bars 21 transversely projecting from the longitudinal face 36, with all the latch bars 20, 21 being spaced from each other and distributed along the elongated member 36 so as to provide multiple locking positions.

Likewise, the upper end of the bracket 30 may be provided with a downwardly extending additional catch slot 32', with both catch slots 32, 32' being alongside with each other and preferably having different depths. The catch slots 32, 32' should preferably be deep enough for full insertion of the latch bars 20, 21.

The bracket 30 has a lower plate portion 50 provided with bolt-receiving holes for securing the bracket 30 to the upright post 10, and an upper plate portion 52 provided with the catch slots 32, 32' and offset from the lower plate portion 50 so as to leave space for passage of the elongated member 34 with the latch bars 20, 21.

As illustrated, the locking assembly is installed on a side of the rocker. But depending on the rocker's design, the locking assembly could be also installed for example in the middle of the rocker, requiring then simple adaptations of the locking assembly to do so. Installation at the middle would possibly be preferable when the locking assembly has only one elongated member 34, thereby reducing potentially wearing torque effect on the rocker that would otherwise occur with a single elongated member 34 on a side of the rocker.

Figure 6:
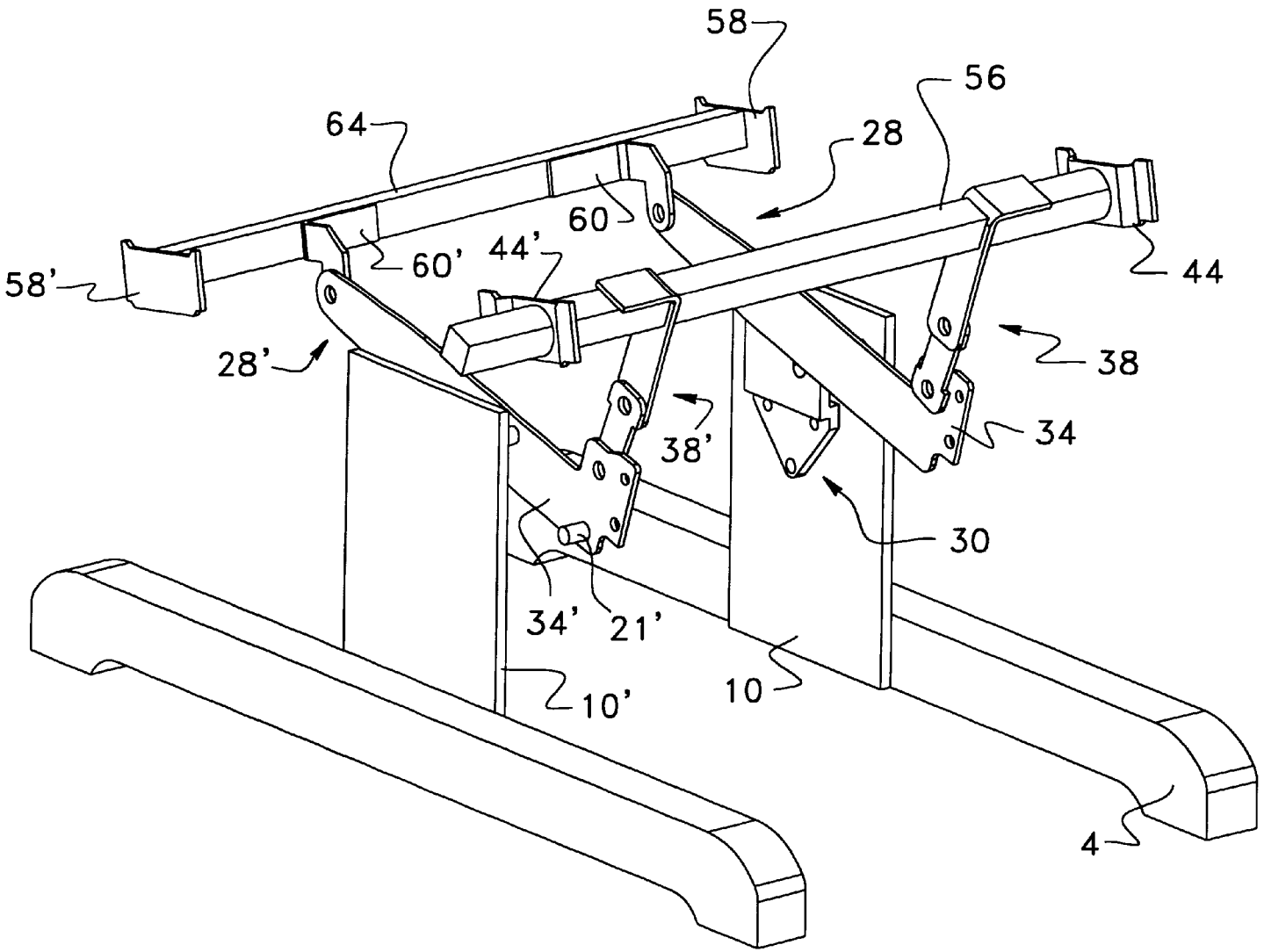
FIG. 6 is a perspective view of the locking assembly according to the invention, without the operating handle, and in respect with the base of a glider rocker.

Preferably, the locking assembly exhibits a relatively symmetrical configuration as depicted in FIGS. 3 and 6, to better distribute the stresses throughout the rocker and the locking assembly. In such a configuration, an additional latch bar 20' (see FIG. 3), an additional mounting assembly 28', and an additional bracket (hidden by the rocker's structure in the Figures) are provided on the right hand side of the rocker (when seated thereon) in the illustrated case, so as to duplicate those on the left hand side of the rocker. A traverse linking 54 extends between both mounting assemblies 28, 28', for linking and interlocking operation of the mounting assemblies 28, 28' with each other. The traverse linking 54 can be formed of a drive rod 56 having opposite ends rotatably mounted in the mounting brackets 44, 44' secured to the upper beams 16 of the chair seat 2 (as shown in FIG. 2) and thereunder.

Referring to FIGS. 3–5, the ends 42 (as best shown in FIGS. 4–5) of the swinging linkages 38, 38' are provided with holes receiving the driving rod 56 in a torque transmission arrangement, as the holes and the driving rod 56 have cooperating rectangular cross-sections. Other suitable shapes can be used for this purpose. Thus, rotation of the driving rod 56 causes the swinging linkages 38, 38' to pivot for deployment or retraction of the members 34, 34' and the latch bars 20, 21, 20', 21'.

A traverse stationary rod 64 has opposite ends provided with mounting brackets 58, 58' secured to the upper beams 16 or other suitable structural members of the chair seat 2, for mounting the stationary rod 64 on the opposite sides of the chair seat 2 and thereunder, at a predetermined distance from the drive rod 56. The distance should preferably correspond to a length of the elongated members 34, 34' with the swinging linkages 38, 38' in retracted, lifting state, to take advantage of the full operational range of the mounting assemblies 28, 28'. The stationary rod 56 is provided with a pair of brackets 60, 60' spaced from each other and respectively pivotally receiving the rear ends of the elongated members 34, 34'. This provides a simple yet effective pivotal connection of the members 34, 34' to the chair seat 2. Other suitable arrangements can nevertheless be used if desired. Preferably, the drive rod 56 will be in front while the stationary rod 56 will be at the back of the chair.

Referring to FIG. 2, the actuating handle 48 has an end provided with a hole receiving an end portion 62 (see FIG. 3) of the drive rod 56 jutting out from one of the mounting brackets 44, 44' by which the drive rod 56 is rotatably mounted to the chair seat 2, i.e. the bracket 44 in the illustrated case. The end portion 62 of the drive rod 56 is received in the hole of the actuating handle 48 in a torque transmission arrangement, in a similar fashion as the torque arrangement between the drive rod 56 and the swinging linkages 38, 38'.

Referring to FIG. 6, the brackets 30 are preferably mounted on inner faces of the upright posts 10, 10' of the base 4, so they are not in the way of the support members 8 (e.g. the bars 14) of the chair seat 2 (see FIG. 1). Likewise, in this configuration, the elongated members 34, 34' and the swinging linkages 38, 38' also extend behind the upright posts 10, 10'. So these elements are relatively hidden in the rocker. The actuating handle 48 preferably extends on an outer side of one of the support members 8 of the chair seat 2, i.e. the right hand side support member 8 in the illustrated case (see FIG. 1).

It should be understood that the locking assembly according to the invention can be used in conjunction with other pieces of furniture, for example a glider ottoman if desired.

Referring to FIG. 2, the chair seat 2 may be conveniently built in two parts (or more), namely the seating portion with the back and arm rests, and a seat base portion made of the upper beams 16 extending under the seating portion and to which the mounting brackets 44, 44', 58, 58' are secured. Such a construction may be particularly useful as the two parts may be shipped in an unassembled compact package, later assembled by the user by bolting or screwing the seating portion onto the seat base portion already mounted over the stationary base 4. In such a configuration, the traverse stationary rod 64 (see FIG. 3) ties the seat base portion together for added structural value, reducing side sway and the possibility of racking as the user glides in the chair. This configuration also allows complete assembly of the stationary base 4 with the seat base portion at the factory without attaching the seating portion for test purposes.

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. A locking assembly for a glider rocker having a gliding chair seat mounted on a stationary base, comprising:

a latch bar adapted to extend horizontally and transversely with respect to a gliding direction of the chair seat;

mounting means for attaching the latch bar to the chair seat, the mounting means being operable for selectively lifting and lowering the latch bar with respect to the chair seat; and a bracket affixable to the base and having an upper end provided with a downwardly extending catch slot into which the latch bar slideably fits when the latch bar is aligned therewith and lowered by operation of the mounting means.

2. The locking assembly according to claim 1, wherein the mounting means comprise an elongated member adapted to extend in the gliding direction, the elongated member having a longitudinal face from which the latch bar transversely projects.

3. The locking assembly according to claim 2, wherein the elongated member has an end that pivotally attaches to the chair seat, and an opposite end provided with a swinging linkage that attaches to the chair seat and is operable to lift and lower the opposite end of the elongated member.

4. The locking assembly according to claim 3, wherein the swinging linkage comprises a twofold arm arrangement having an end pivotally connected to the opposite end of the elongated member, an opposite end that attaches to the chair seat, and an intermediate pivot point.

5. The locking assembly according to claim 4, further comprising an actuating handle operatively coupled to the opposite end of the twofold arm arrangement to rotate the opposite end of the twofold arm arrangement and selectively swing the swinging linkage up and down.

6. The locking assembly according to claim 2, wherein the elongated member is provided with additional latch bars transversely projecting from the longitudinal face, the latch bars being spaced from each other and distributed along the elongated member.

7. The locking assembly according to claim 1, wherein the upper end of the bracket is provided with a downwardly extending additional catch slot, both catch slots being alongside with each other and having different depths.

8. The locking assembly according to claim 7, wherein the bracket has a lower plate portion provided with bolt-receiving holes, and an upper plate portion offset from the lower plate portion, the upper plate portion being provided with the catch slots.

9. The locking assembly according to claim 1, further comprising:

additional latch bar adapted to extend horizontally and transversely with respect to a gliding direction of the chair seat;

additional mounting means for attaching the additional latch bar to the chair seat, the additional mounting means being operable for selectively lifting and lowering the additional latch bar with respect to the chair seat;

an additional bracket affixable to the base and having an upper end provided with a downwardly extending catch slot into which the additional latch bar slideably fits when the additional latch bar is aligned therewith and lowered by operation of the additional mounting means; and transverse linking means extending between both mounting means, for linking operation of the mounting means with each other.

10. The locking assembly according to claim 9, wherein:

each mounting means comprise an elongated member adapted to extend in the gliding direction, the elongated member having a longitudinal face from which a corresponding one of the latch bars transversely projects;

each elongated member has an end that pivotally attaches to the chair seat, and an opposite end provided with a swinging linkage that attaches to the chair seat and is operable to lift and lower the opposite end of the elongated member;

each swinging linkage comprises a twofold arm arrangement having an end pivotally connected to the opposite end of a corresponding one of the elongated members, an opposite end that attaches to the chair seat, and an intermediate pivot point; and the transverse linking means comprises a drive rod having opposite ends provided with mounting brackets for rotatably mounting the drive rod on opposite sides of the chair seat and thereunder, the opposite ends of the swinging linkages being provided with holes receiving the driving rod in a torque transmission arrangement;

the locking assembly further comprising:

a transverse stationary rod having opposite ends provided with mounting brackets for mounting the stationary rod on the opposite sides of the chair seat and thereunder, at a predetermined distance from the drive rod corresponding to a length of the elongated members with the swinging linkages in retracted, lifting state, the stationary rod being provided with a pair of brackets spaced from each other and respectively pivotally receiving the ends of the elongated members; and an actuating handle having an end provided with a hole receiving an end portion of the drive rod jutting out from one of the mounting brackets by which the drive rod is rotatably mounted to the chair seat, the end portion of the drive rod being received in the hole of the actuating handle in a torque transmission arrangement.

11. A glider rocker comprising:

a stationary base;

a gliding chair seat mounted on the stationary base; and a locking assembly including:

a latch bar extending horizontally and transversely with respect to a gliding direction of the chair seat;

mounting means attaching the latch bar to the chair seat, the mounting means being operable for selectively lifting and lowering the latch bar with respect to the chair seat; and a bracket affixed to the base and having an upper end provided with a downwardly extending catch slot into which the latch bar slideably fits when the latch bar is aligned therewith and lowered by operation of the mounting means.

12. The glider rocker according to claim 11, wherein the locking assembly further comprises an additional latch bar extending horizontally and transversely with respect to the gliding direction of the chair seat;

additional mounting means attaching the additional latch bar to the chair seat, the additional mounting means being operable for selectively lifting and lowering the additional latch bar with respect to the chair seat;

an additional bracket affixed to the base and having an upper end provided with a downwardly extending catch slot into which the additional latch bar slideably fits when the additional latch bar is aligned therewith and lowered by operation of the additional mounting means; and transverse linking means extending between both mounting means and under the chair seat, for linking operation of the mounting means with each other.

13. The glider rocker according to claim 12, wherein:

each mounting means comprise an elongated member extending in the gliding direction, the elongated member having a longitudinal face from which a corresponding one or the latch bars transversely projects;

each elongated member has an end pivotally attached to 20 the chair seat, and an opposite end provided with a swinging linkage attached to the chair seat and operable to lift and lower the opposite end of the elongated member;

each swinging linkage comprises a twofold arm arrangement having an end pivotally connected to the opposite end of a corresponding one of the elongated members, an opposite end attached to the chair seat, and an intermediate pivot point; and the transverse linking means comprises a drive rod having opposite ends provided with mounting brackets rotatably mounting the drive rod on opposite sides,of the chair seat and thereunder, the opposite ends of the swinging linkages being provided with holes receiving the driving rod in a torque transmission arrangement.

14. The glider rocker according to claim 13, wherein the locking assembly further comprises:

a transverse stationary rod having opposite ends provided with mounting brackets mounting the stationary rod on the opposite sides of the chair seat and thereunder, at a predetermined distance from the drive rod corresponding to a length of the elongated members with the swinging linkages in retracted, lifting state, the stationary rod being provided with a pair of brackets spaced from each other and respectively pivotally receiving the ends of the elongated members; and an actuating handle having an end provided with a hole receiving an end portion of the drive rod jutting out from one of the mounting brackets by which the drive rod is rotatably mounted to the chair seat, the end portion of the drive rod being received in the hole of the actuating handle in a torque transmission arrangement.

15. The glider rocker according to claim 14, wherein:

the stationary base comprises a pair of parallel upright support members extending on opposite sides of the base;

the chair seat comprises a pair of parallel downwardly projecting side support members extending on the opposite sides of the chair seat and on outer sides of the support members of the base;

the chair seat is glidingly mounted on the base by means of front and rear pairs of parallel linkage bars having ends pivotally connected to the support members of the chair seat and the base respectively, at front and rear ends thereof;

the brackets are mounted on inner faces of the support members of the base facing each other;

the elongated members and the swinging linkages extend between the support members of the base and under the chair seat; and the actuating handle extends on an outer side of one of the support members of the chair seat.

16. The glider rocker according to claim 15, wherein the elongated members are provided with additional latch bars transversely projecting from the longitudinal faces, the latch bars being spaced from each other and distributed along the elongated members.

17. The glider rocker according to claim 16, wherein the upper end of the brackets is provided with a downwardly extending additional catch slot, both catch slots of each bracket being alongside with each other and having different depths.

* * * * *